United States Patent [19]

Ajioka et al.

[11] Patent Number: 4,725,795

[45] Date of Patent: Feb. 16, 1988

[54] CORRUGATED RIDGE WAVEGUIDE PHASE SHIFTING STRUCTURE

[75] Inventors: James S. Ajioka, Fullerton; Robert T. Clark, Buena Park; Dean C. Quick, Placentia, all of Calif.

[73] Assignee: Hughes Aircraft Co., Los Angeles, Calif.

[21] Appl. No.: 767,302

[22] Filed: Aug. 19, 1985

[51] Int. Cl.[4] ..... H01P 1/161; H01P 1/17; H01P 1/213; H01P 1/18

[52] U.S. Cl. ..... 333/126; 333/135; 333/21 A; 333/157; 333/160; 333/33

[58] Field of Search ..... 333/157, 160, 156, 21 A, 333/21 R, 248, 251, 33, 126, 129, 135, 137

[56] References Cited

U.S. PATENT DOCUMENTS

| | | | |
|---|---|---|---|
| 2,772,400 | 11/1956 | Simmons | 333/157 X |
| 2,911,695 | 11/1959 | Cutler | 333/157 X |
| 3,949,327 | 8/1974 | Chapell | 333/251 X |
| 4,305,051 | 12/1981 | Hai | 333/21 A |
| 4,596,968 | 6/1986 | Vita | 333/157 |

*Primary Examiner*—Eugene R. Laroche
*Assistant Examiner*—Benny Lee
*Attorney, Agent, or Firm*—Thomas A. Runk; Anthony W. Karambelas

[57] ABSTRACT

A differential phase shifting structure is disclosed, employing corrugated ridges in square or round waveguides or in coaxial lines operating in the $TE_{11}$ mode. The structure provides a substantially constant differential phase shift between two waves polarized orthogonally to each other. The corrugations in the ridge provide a series inductance which can be optimized with the shunt capacitance of the ridge to provide a characteristic impedance matching that of the unloaded structure. The corrugated ridges provide increased differential phase shift per unit length. The differential phase shifting structure is particularly well suited to such applications as circular polarizers, quarter wave plates or polarization rotating half-wave plates.

14 Claims, 14 Drawing Figures

FIG. 9
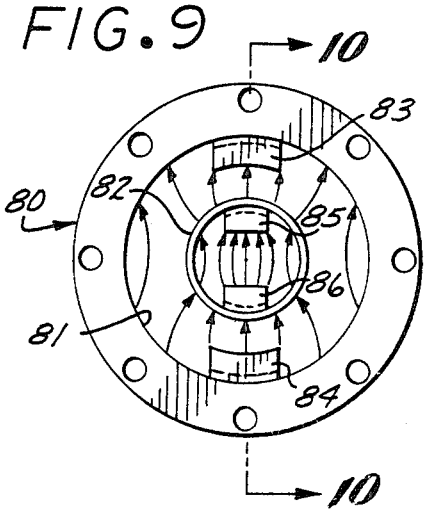
FIG. 11
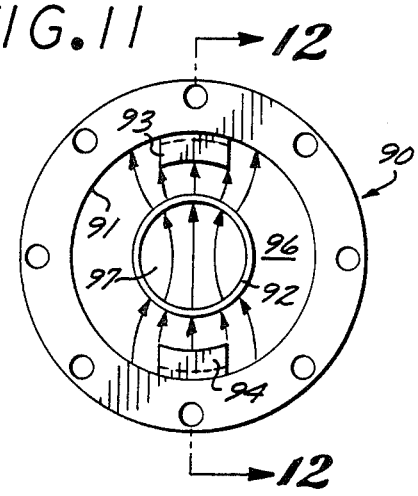
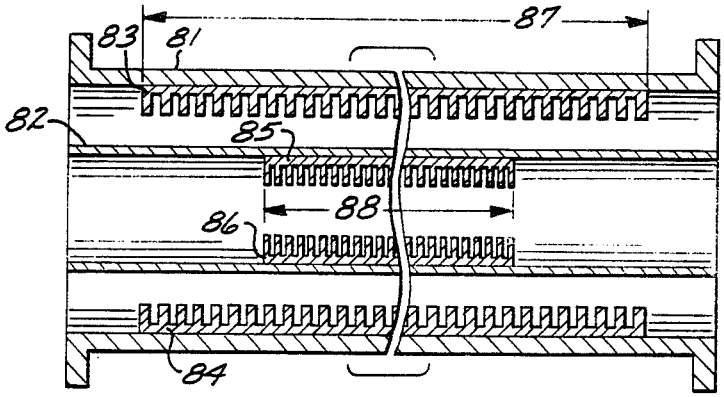
FIG. 10
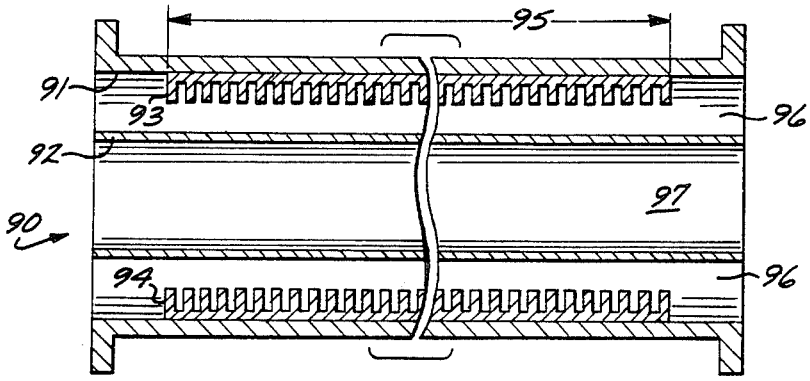
FIG. 12

CORRUGATED RIDGE WAVEGUIDE PHASE SHIFTING STRUCTURE

The Government has rights in this invention pursuant to Contract No. F19628-83-C-0102 awarded by the Department of the Air Force.

BACKGROUND OF THE INVENTION

The invention relates to microwave phase shifting structures, and more particularly to wave transmission structures providing differential phase shift between two waves polarized orthoganally to each other.

Structures providing differential phase shift between two orthogonal linear polarizations have a variety of applications. The most common application is for circular polarizers in which the differential phase shift is 90° (quarter-wave plate). A differential phase shift of 180° (half-wave plate) is used as a polarization rotator for linear polarization and as a phase shifter for circular polarization, e.g., Fox, A. G., "An Adjustable Waveguide Phase Changer," PROC. IRE, Vol. 35, No. 12, pp. 1489–1498, December 1947. In conjunction with orthopolarization mode transducers they can be used as power dividers. These structures may also be used for a single polarization as fixed phase shifters.

Conventional differential phase shift structures are understood to employ periodic lumped or distributed shunt capacitive or periodic lumped or distributed shunt inductive loading in the differential phase shift region which is inherently mismatched with the unloaded waveguide; hence an impedance matching section is required at each end of the phase shift section. One conventional design is illustrated in the paper "Phase Shift by Periodic Loading of Waveguide and Its Application to Broad-Band Circular Polarization," by A. J. Simmons, IRE Transactions, Microwave Theory and Techniques, December, 1955, pages 18–21. Other designs are illustrated in "Microwave Transmission Circuits," edited by George L. Ragan, MIT Rad. Lab Series Volume 9. FIGS. 6.59–6.63 illustrate various configurations employing shunt capacitive fin loading for a quarter-wave plate circular polarizer, shunt inductive loading in a quarter-wave plate circular polarizer, and an array of shunt capacitive posts in a differential phase shift section. FIG. 6.69 illustrates two designs employing capacitive dielectric slabs.

However, none of these prior methods use shunt capacitive and series inductive loading in the same structure and in the proper ratio to achieve impedance matching to the unloaded waveguide and at the same time achieve greater differential phase shift per unit length, thus obviating the need for impedance transformers at each phase shift section.

It would therefore be advantageous to provide a structure for achieving a differential phase shift between two waves polarized orthogonally to each other, and which is impedance matched between the unloaded waveguide and the phase shifting section for both components of polarization. Such a structure would not require impedance transformer sections at each end of the phase shift section, thereby reducing the overall length and complexity of the structure.

It would further represent an advance in the art to provide an easily fabricated, differential phase shift per unit length structure which provides a relatively large differential phase shift per unit length, with low insertion loss over a relatively large bandwidth.

SUMMARY OF THE INVENTION

A wave transmission structure is disclosed which provides a relatively large differential phase shift per unit length between two electromagnetic waves polarized orthogonally to each other. In accordance with the invention, two elongated conductive ridge members are oppositely disposed along at least a portion of the wave transmission structure, with a series of lateral corrugations defined along the extent of the ridge members. The corrugations have a depth of less than one quarter of the wavelength of interest and provide a means of loading the wave transmission structure with a series susceptance. The magnitude of the series susceptance is dependent on the depth and spacing of the corrugations in the ridge members. The ridge members also provide a shunt susceptance whose magnitude per unit length is dependent on the height and width of the ridge members. The respective series and shunt susceptance are adjusted by appropriate selection of the ridge and corrugation parameters so that the characteristic impedance of the loaded section of the wave transmission structure matches that of the unloaded section. With the series and shunt susceptive loading, the structure provides a relatively large differential phase shift per unit length. .

BRIEF DESCRIPTION OF THE DRAWINGS

These and other features and advantages of the present invention will become more apparent from the following detailed description of an exemplary embodiment thereof, as illustrated in the accompanying drawings, in which:

FIGS. 9 and 10 are respective end and cross-sectional side views of a coaxial waveguide structure embodying the invention for providing a dual frequency band differential phase shifting function.

FIGS. 11–12 are respective end and cross-sectional side views of a coaxial waveguide structure embodying the invention for providing a differential phase shifting function in a lower frequency band and carrying a signal in a high frequency band without differential phase shifting inside the hollow inner conductor.

DETAILED DESCRIPTION OF THE DISCLOSURE

The present invention comprises a novel corrugated ridge waveguide phase shifting structure. The following description is presented to enable a person skilled in the art to make and use the invention, and is provided in the context of a particular application and its requirements. Various modifications to the preferred embodiment may be apparent to those skilled in the art. Thus, the present invention is not intended to be limited to the embodiment shown, but is intended to be accorded the widest scope consistent with the principles and novel features disclosed herein.

Figure 1:
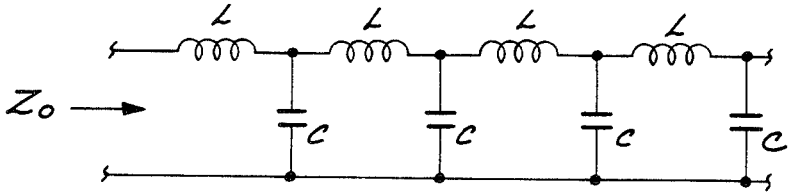
FIG. 1 is a simplified equivalent schematic circuit representing the impedance of a waveguiding structure or transmission line by electrical connection of inductances and capacitances.

To facilitate an understanding of the invention, it is helpful to refer to the schematic illustration in FIG. 1, representing the equivalent circuit of a waveguiding structure or transmission line. The equivalent circuit comprises cascaded series inductances L and shunt capacitances C. The characteristic impedance $Z_o$ and the phase velocity v are related to the series inductance L per unit length and the shunt capacitance C per unit length by the expressions of Equations 1 and 2.

$$Z_o \sim (L/C)^{\frac{1}{2}} \quad (1)$$

$$v \sim (LC)^{-\frac{1}{2}} \quad (2)$$

The phase change per unit length ($\beta$) is related to the R.F. frequency F and the phase velocity, as well as the series inductance L and shunt capacitance C, by the expressions of Equations 3 and 4.

$$\beta = \omega/v \quad (3)$$

where $\omega = 2\pi F$ $$\beta \sim \omega(LC)^{\frac{1}{2}} \quad (4)$$

If the series inductance L and the shunt capacitance C are changed by the same ratio, the characteristic impedance $Z_o$ would not change, but the phase change per unit length ($\beta$) would change in proportion to the square root of the product of the series inductance L and the shunt capacitance.

In accordance with the invention, corrugated ridges are employed in the phase shift waveguide structure which increase the series inductance L and shunt capacitance C over that of the unridged waveguide for waves with the electric field polarized parallel to the plane of the ridge. For waves with the electric field polarized perpendicular to the ridges, the ridges have much less effect on either the characteristic impedance or the phase shift per unit length of the unloaded waveguide.

The net result is a differential phase shift between waves polarized parallel to the ridges and waves polarized perpendicular to the ridges. The differential phase shift is given by Equation 5.

$$\Delta \text{ phase} = (\beta_{11} - \beta_1)l, \quad (5)$$

where l is the length of the phase shift section, $\beta_{11}$ is the phase shift per unit length for waves polarized parallel to the ridge, and $\beta_1$ is the phase shift per unit length for waves polarized perpendicular to the ridge.

The characteristic impedance presented by the phase shift section to the respective orthogonally polarized waves will be the same, if the ratio L/C remains the same. This will be the case if the relationship of Equation 6 is maintained.

$$L_1/C_1 = L_{11}/C_{11} = L/C \quad (6)$$

where $L_1$, $L_{11}$, $C_1$, $C_{11}$ represent the series inductance and shunt capacitance presented to waves having their electric fields respectively polarized perpendicular and parallel to the ridges.

The magnitude of the shunt capacitance is controlled by the height and the width of the ridge. The series inductance is controlled by the depth of the corrugation (D) and the characteristic impedance of the corrugation gap ($Z_{ogap}$). If the depth D is less than a quarter wavelength, a corrugation provides a series inductance L proportional to the number of corrugations per unit length and to ($Z_{ogap}$) (tan $\beta_{gap}$D), where $Z_{ogap}$ is the characteristic impedance of the gap and $\beta_{gap}$ is the propagation constant of the gap.

The advantages of corrugated ridge structures employing the invention over the conventional designs referred to above result from several factors. The corrugated ridge structures allows control of the series inductance per unit length as well as the shunt capacitance. The ratio of the series inductance and shunt capacitance can be controlled to effect an impedance match to the unridged waveguide. The capability to adjust the series inductance results in greater versatility in applying the invention to a particular application to achieve lower insertion loss, larger phase shift per unit length, and broader bandwidth.

Conventional designs using only shunt susceptances are inherently mismatched to the unloaded waveguide, and hence require matching transformers at each end. The corrugated ridge design is shorter than the convention designs providing the same amount of differential phase shift for two reasons. Because the corrugated ridge design allows for characteristic impedance matching, smaller impedance matching sections are required. Also, the corrugated ridge design provides greater phase change per unit length because both the series inductance L and shunt capacitance C contribute to the phase shift by the square root of their product.

Figure 2:
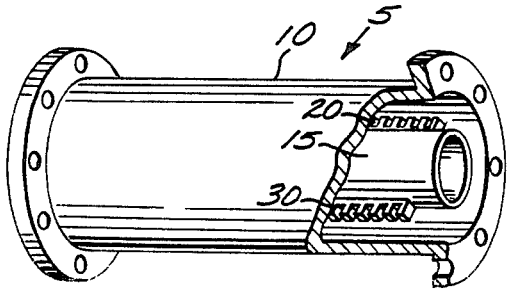
FIGS. 2–4 are respective perspective, end and cross-sectional side views of a millimeter wave coaxial waveguide structure employing the invention to provide differential phase shift.
Figure 3:
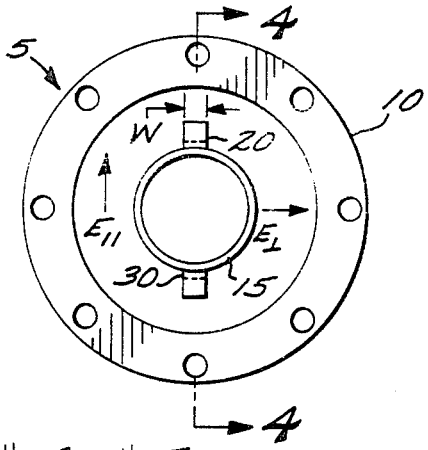
Figure 4:
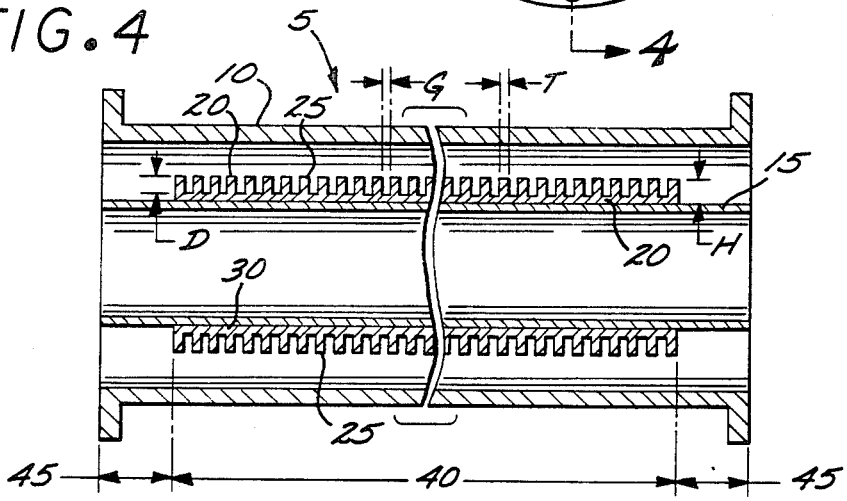

Referring now to FIGS. 2–4, an exemplary embodiment of a phase shifting structure employing the invention is illustrated. This embodiment is a millimeter wave circular polarizer 5 in coaxial waveguide, operating in the $TE_{11}$ mode. The coaxial waveguide comprises an outer conductor 10 and an inner conductor 15 concentrically disposed inside the outer conductor 10, both of circular cross section. In accordance with the invention, corrugated ridge members 20, 30 are formed on and extend symmetrically outwardly in opposing directions from the center conductor 15. The corrugations 25 have a width T, a spacing G and a depth D. Each ridge 20 and 30 has a total height H and a width W. In this embodiment, 16 corrugations per unit wavelength in the coaxial waveguide are formed in each ridge (See FIGS. 3 and 4).

In general, the differential phase shift per unit length is increased as the number of corrugations is increased. Thus, while a structure embodying the inventions may have some utility when only a few, for example, five corrugations per unit length are employed, the advantages of high differential phase shift are believed to be provided when many corrugations (ten or greater) per unit length are employed.

For a wave with electric field polarization parallel to the ridged sections 20 and 30, i.e., $E_{11}$ as shown in FIG. 3, the loading provided by the ridges 20 and 30 5 is capacitive. If the depth D of the corrugations is less than a quarter wavelength, the corrugated ridges 20 and 30 also provide a series inductive loading. By proper choice of the ridge dimensions, the characteristic impedance in the phase shifting section 40, determined by the square root of the ratio of the inductance L per unit length and the capacitane C per unit length (L/C), can be made equal to the characteristic impedance of the unridged waveguide sections 45, thereby achieving a characteristic impedance match between the unridged to ridged waveguide sections. For this condition, the phase velocity in the ridged section 40 will be reduced in proportion to the square root of the product of the shunt capacitance C per unit length and the series inductance L per unit length.

For electric field polarization orthogonal to the ridge, i.e., $E_1$ as shown in FIG. 3, the effect of the corrugated ridges 20, 30 on the phase velocity is minimal, and the characteristic impedance is very nearly the same as the unridged sections of the waveguide 45 if the ridge is thin, i.e., if the ridge width W is relatively small in relation to the width of the outer waveguide conductor in the same region.

As described above, the net result is that the device 5 provides a differential phase shift between waves with the electric field polarized parallel to the corrugated ridge and waves with the electric field polarized orthogonal to the ridge, and also presents an impedance match for waves of both polarizations. Thus, impedance matching structures are not required when the ridge is relatively thin. Moreover, the device 5 provides a larger differential phase change per unit length than with conventional uncorrugated ridges.

To provide the circular polarization function, the differential electrical length of the differential phase shift section 40 is equal to one quarter of the wavelength. The differential phase shift (Δ phase) provided by a quarter wavelength differential electrical length is 90°. The appropriate length of the phase shift section for a particular frequency and a given corrugated ridge design may be determined from Equations 1–5.

It is to be noted that while the exemplary embodiment depicted in FIGS. 2–4 illustrates the application of the invention to coaxial waveguides operating in the $TE_{11}$ mode, the technique can be applied to other configurations as well, such as round or square waveguide. This exemplary device represents an application which presents difficulties to conventional designs, since it is generally more difficult to design a polarizer in higher order mode coaxial line than in dominant mode waveguide. Moreover, the mechanical tolerances are quite critical for millimeter wave applications.

Measurements on the device 5 illustrated in FIGS. 2–4 and having the dimensions indicated in Table 1, indicate that, over about a 10% frequency bandwidth, the device 5 exhibits a differential phase shift that deviates from the ideal 90° by less than ±3° and a power reflection of less than 1%.

TABLE 1

| | |
|---|---|
| Outer conductor diameter: | 1.12 mm (.439 inches) |
| Inner conductor diameter: | .54 mm (.212 inches) |
| Ridge width W: | .06 mm (.025 inches) |
| Corrugation depth D: | .11 mm (.045 inches) |
| Corrugation spacing G: | .005 mm (.019 inches) |
| Corrugation width T: | .005 mm (.019 inches) |
| Ridge height H: | .015 mm (.060 inches) |
| Length of corrugated section 40: | 101 mm .399 inches |

Figure 5:
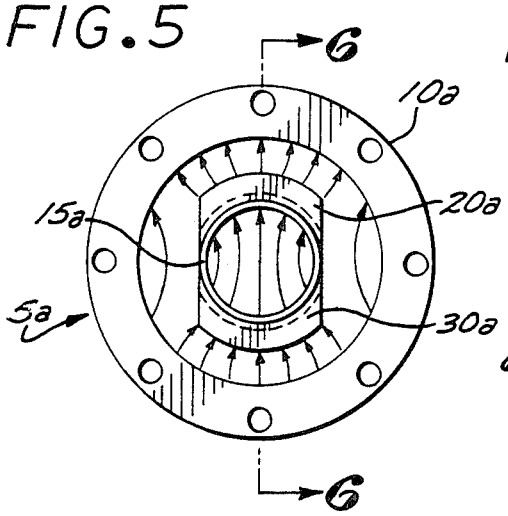
FIGS. 5 and 6 are respective end and cross-sectional side views of a millimeter wave coaxial waveguide structure employing the invention with relatively wide corrugated ridges.
Figure 6:
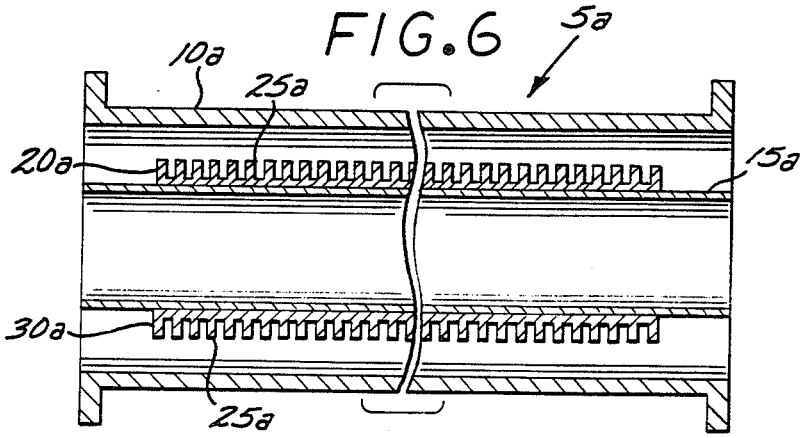

Useful results are also obtained with devices employing wider ridges, e.g., as wide as the center conductor. An exemplary device 5a employing wide ridges 20a and corrugation 25a within an outer conductor 10a is shown in FIGS. 5 and 6. Exemplary electric field lines are depicted in FIG. 5, illustrating the $TE_{11}$ mode of operation for this embodiment. In this embodiment, the width W of the ridges 20a, 30a is the same as the diameter of inner conductor 15a, as shown in FIG. 5. It is simpler to employ this ridge width because it is easier to mill flat sides on circular corrugations which have been turned on a lathe than to mill a thin corrugated ridge on a cylindrical center conductor.

With the wide ridge embodiment of FIGS. 5 and 6, the impedance matching is degraded from the structure employing thin ridges, and it may be useful to employ short impedance transformers. Because a quarter wavelength in the corrugated media is shorter than that of the unloaded waveguide, these transformers are quite short. This composite length of the phase shifter employing wide ridges with the impedance transformer is still shorter than the conventional phase shifter structure employing solid ridges. Due to packaging constraints in some applications, the length of the structure is an important characteristic.

Figure 7:
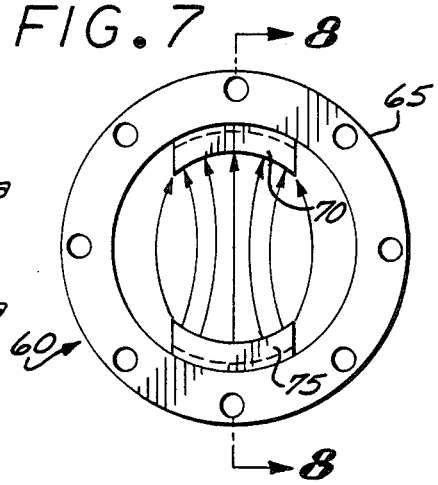
FIGS. 7 and 8 are respective end and cross-sectional side views of a millimeter wave circular waveguide structure employing the invention to provide differential phase shift.
Figure 8:
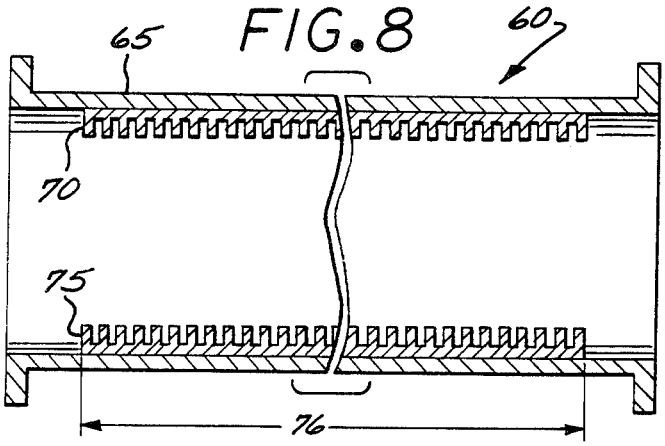

Another embodiment of the invention is illustrated in FIGS. 7 and 8. In this structure 60, the corrugated ridge members 70, 75 are disposed in a circular waveguide 65 in a diametrically opposed relationship to define a differential phase shifting section 76. Exemplary field lines depicting the $TE_{11}$ mode of operation for this embodiment are shown in FIG. 7.

FIGS. 9 and 10 depict another embodiment of the invention which is suitable for dual frequency operation. The dual frequency structure 80, is suitable for use in a dual frequency RF system. The structure 80 comprises a hollow outer conductor 81 and a hollow inner conductor 82 disposed concentrically within the outer conductor 81. Corrugated ridges 83 and 84 are disposed in a diametrically opposed relationship on the inside surface of the outer conductor 81 to form a first differential phase shifting section 87. Similarly, the corrugated ridges 85 and 86 are disposed in a diametrically opposed relationship on the inner surface of the inner conductor 82 to form a second differential phase shifting section 88. Exemplary electric field lines are shown in FIG. 9, depicting the $TE_{11}$ mode of operation for this embodiment.

The annular region between the conductors 81 and 82 may be used to conduct a signal whose frequency is within a first frequency band and provide a differential phase shift to the first signal. The cylindrical region within the inner conductor 82 may be used to conduct a second signal whose frequency is within a second frequency band which is higher than the first bandwidth. Thus, the structure 80 is a dual frequency, differential phase shifting structure. The dimensions of the respective corrugated ridge pairs 81–82 and 83–84 are selected to provide the desired respective first and second differential phase shifts. With the inner conductor 82 carrying a high frequency wave than the outer conductor 81, the relative dimensions of the corrugated ridges 85, 86 are scaled down from the dimensions of the corrugated ridges 83, 84, as will be apparent to those skilled in the art.

FIGS. 11–12 depict another embodiment of the invention. This embodiment is similar to the dual frequency, differential phase shift structure shown in FIGS. 9–10, except that no corrugated ridges are disposed within the hollow inner conductor. Thus, the structure 90 comprises a hollow cylindrical outer conductor 91 and a hollow cylindrical inner conductor 92.

Corrugated ridges 93 and 94 are disposed on the inner surface of the outer conductor 91 in a diametrically opposed relationship to define a differential phase shift section 95 (FIG. 12) in the annular region 96 between the inner and outer conductors 91 and 92. As with the embodiments depicted in FIGS. 2–10, this coaxial wave transmission structure operates in the $TE_{11}$ mode, illustrated by the electric field line depicted in FIG. 11, as opposed to the usual TEM mode for cylindrical waveguides. The annular region 96 carries a first signal in a lower frequency band and provides a differential phase shift, while a second signal in a higher frequency band is carried inside the hollow inner conductor region 97. The structure 90 does not provide a differential phase shift to the second signal.

Figure 13:
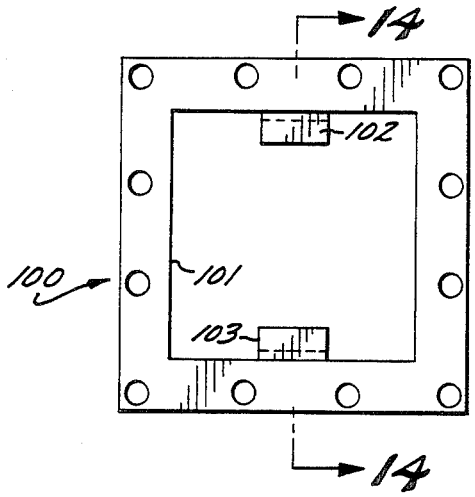
FIGS. 13–14 are respective end and cross-sectional side views of a square waveguide structure embodying the invention.
Figure 14:
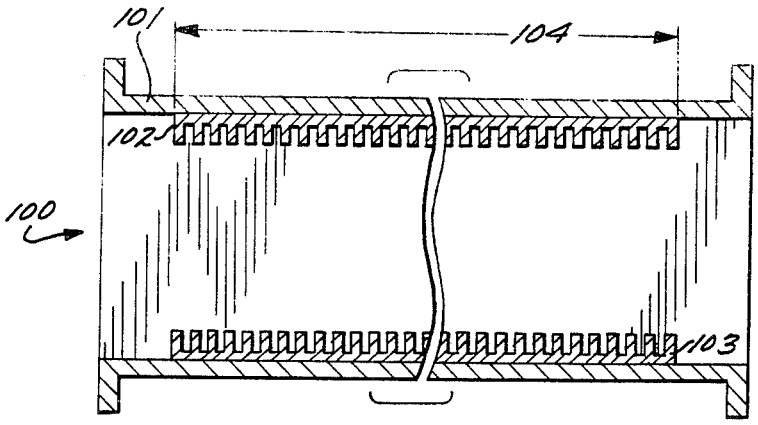

FIGS. 13–14 depict an embodiment of the invention in square waveguide. The structure 100 comprises a square waveguide 101 and a pair of corrugated ridges 102 and 103 which form a differential phase shifting section 104. This embodiment operates in the $TE_{10}$ mode.

A differential phase shift structure has been described, which provides shunt and series susceptance loading to provide impedance matching and increased differential phase shift per unit length. It is understood that the above-described embodiments are merely illustrative of the possible specific embodiments which can represent principles of the present invention. Other arrangements may be devised in accordance with these principles by those skilled in the art without departing from the scope of the invention.

What is claimed is:

1. A differential phase shifting structure for providing differential phase shift between electromagnetic waves of relative orthogonal polarization, comprising:

a waveguiding structure having a longitudinal extent and an unloaded characteristic impedance, wherein said waveguiding structure comprises a circular waveguide defined by a cylindrical conductor;

shunt loading means for distributively loading said waveguiding structure with shunt capacitance to define a phase shifting section thereof; and series loading means for distributively loading said waveguiding structure with series inductance in said phase shifting section thereof;

said series and shunt loading means presenting a characteristic impedance to each of said electromagnetic waves which substantially matches said unloaded characteristic impedance of said waveguiding structure;

said shunt loading means comprises a pair of elongated conductive ridge members symmetrically disposed longitudinally along the inner surface of said cylindrical conductor in a diametrically opposed relationship, and disposed longitudinally along the length of said phase shifting section, and said series loading means comprises a plurality of corrugations disposed in said ridge members along the longitudinal direction of said ridge members, said corrugations having a depth which is less than one quarter of the wavelength of interest.

2. A dual frequency, differential phase shifting structure for providing different phase shift between electromagnetic waves of relative orthogonal polarization, comprising:

a coaxial waveguide structure defined by a cylindrical outer conductor and a concentric cylindrical inner conductor, said waveguide structure dimensioned to support conduction of electromagnetic energy in a first frequency band in the annular region between said inner and outer conductors and to support conduction of electromagnetic energy in a second frequency band inside the inner conductor;

a first pair of conductive corrugated ridge members disposed in a diametrically opposed relationship along the inner surface of said outer conductor to form a first differential phase shifting section;

a second pair of conductive corrugated ridge members disposed in a diametrically relationship along the inner surface of said inner conductor to form a second differential phase shifting section;

wherein said phase shifting structure is for dual frequency, differential phase shifting operation in said first and second frequency bands.

3. The structure of claim 2 wherein said coaxial waveguide structure has a particular first characteristic impedance in the region between said inner and outer conductor and a second characteristic impedance in the region within said inner conductor, and wherein said first and second pairs of corrugated ridge members are respectively dimensioned to increase the series inductance and shunt capacitance per unit length of said respective first and second differential phase shifting sections and to achieve an impedance match between respectively said first characteristic impedance and the characteristic impedance of said first phase shifting section and between said second characteristic impedance and the characteristic impedance of said second phase shifting section.

4. A differential phase shifting structure for providing differential phase shift between electromagnetic waves of orthogonal electric field polarization, comprising:

a waveguiding structure having a longitudinal extent and a lateral extent normal to said longitudinal extent, which comprises a coaxial waveguide structure defined by a cylindrical outer conductor and a cylindrical inner conductor positioned about an axis extending along said longitudinal extent; and first and second conductive ridge member means disposed on the outer surface of said inner conductor in a diametrically opposed relationship along at least a part of the longitudinal extent of said waveguiding structure to define a phase shifting section in said structure, said phase shifting section having a characteristic impedance;

wherein each of said ridge means comprises a plurality of corrugation means disposed along the longitudinal direction of said waveguiding structure, each of said corrugation means having a depth of less than one quarter of a selected wavelength of interest; and wherein said waveguiding structure has a particular characteristic impedance, and wherein said ridge member means and said plurality of corrugation means are dimensioned to increase the series inductance L per unit length and shunt capacitance C per unit length of the phase shifting section of said waveguiding structure and to achieve an impedance match between the respective characteristic impedance of said waveguiding structure and said phase shifting section.

5. The structure of claim 4 wherein said ridge member means have a width dimension normal to said axis, said width dimension being substantially less than the diameter of said inner conductor, and wherein the dimensions of said ridge member means and said corrugation means are chosen such that the characteristic impedance of said phase shift section of said waveguiding structure substantially matches that of the waveguiding structure without the the ridge member means.

6. The structure of claim 4 wherein said ridge member means have a width dimension normal to said axis, said width dimension being substantially equal to the diameter of said inner conductor.

7. A millimeter wavelength circular polarizer, comprising:

a length of coaxial waveguide structure dimensioned to support conduction of millimeter wavelength energy, defined by a cylindrical outer conductor and a cylindrical inner conductor disposed about a common axis within said outer conductor;

first and second conductive ridge members disposed longitudinally along the outer surface of said inner conductor in a diametrically opposed relationship to form a differential phase shifting section within said waveguide;

a plurality of corrugations formed along the longitudinal direction of each of said ridge members; and wherein the dimensions of said ridge members and said corrugations are adapted to provide a differential phase shift of 90° along the extent of said differential phase shifting structure.

8. The circular polarizer of claim 7 wherein said coaxial waveguide structure has an unloaded characteristic impedance, and wherein said ridge members and said corrugations defined therein are dimesioned such that the characteristic impedance presented by said phase section to respective orthogonally polarized waves is substantially matcheed to said unloaded characteristic impedance.

9. The circular polarizer of claim 8 wherein the width dimension of said ridge members which is normal to said axis is relatively small in relation to the diameter of said inner conductor, and wherein at least sixteen corrugations are formed in said corrugated ridge members for each wavelength of interest.

10. The circular polarizer of claim 7 wherein the width dimension of said ridge members which is normal to said axis is substantially the same dimension as the diameter of said inner conductor.

11. A differential phase shifting structure for providing differential phase shift between electromagnetic waves of relative orthogonal polarization, comprising:

a waveguiding structure having a longitudinal extent and an unloaded characteristic impedance, wherein said waveguiding structure comprises a coaxial waveguide structure dimensioned to support conduction of millimeter wavelength energy, said structure defined by a cylindrical outer conductor formed about an axis extending along said longitudinal extent and a coaxially disposed, cylindrical inner conductor;

shunt loading means for distributively loading said waveguiding structure with shunt capacitance to define a phase shifting section thereof; and series loading means for distributively loading said waveguiding structure with series inductance in said phase shifting section thereof;

said series and shunt loading means presenting a characteristic impedance to each of said electromagnetic waves which substantially matches said unloaded characteristic impedance of said waveguiding structure;

said shunt loading means comprises a pair of elongated conductive ridge members symmetrically disposed longitudinally along the outer surface of said inner conductor in a diametrically opposed relationship, and disposed longitudinally along the length of said phase shifting section, and said series loading means comprises a plurality of corrugations disposed in said ridge members along the longitudinal direction of said ridge members, said corrugations having a depth which is less than one quarter of the wavelength of interest.

12. The differential phase shifting structure of claim 11 wherein said phase shifting section has a differential electrical length with respect to electromagnetic fields of orthogonal electrical field polarization equal to one quarter of the wavelength of interest, whereby said phase shifting structure provides a circular polarizer function.

13. The differential phase shifting structure of claim 11 wherein said ridge members have a width dimension normal to said axis, said width dimension being relatively small in relation to the diameter of said inner conductor.

14. The differential phase shifting structure of claim 11 wherein said ridge members have a width dimension normal to said axis, said width dimension being substantially equal to the diameter of said inner conductor.

* * * * *